US006227296B1

(12) United States Patent
Reppert et al.

(10) Patent No.: US 6,227,296 B1
(45) Date of Patent: May 8, 2001

(54) METHOD TO REDUCE WATER SATURATION IN NEAR-WELL REGION

(75) Inventors: Todd R. Reppert, Houston, TX (US); W. Keith Idol, Mandeville, LA (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 09/426,445

(22) Filed: Oct. 25, 1999

Related U.S. Application Data

(60) Provisional application No. 60/106,863, filed on Nov. 3, 1998.

(51) Int. Cl.[7] ..... E21B 43/16

(52) U.S. Cl. ..... 166/305.1; 166/263; 166/400

(58) Field of Search ..... 166/400, 401, 166/402, 403, 263, 309, 305.1

(56) References Cited

U.S. PATENT DOCUMENTS 3,630,286 * 12/1971 Persinski ..... 266/309
3,783,945 * 1/1974 Dauben et al. ..... 166/305.1
3,868,999 * 3/1975 Christopher, Jr. et al. ..... 166/292
4,154,300 * 5/1979 Vinatieri et al. ..... 166/252.1
4,390,068 * 6/1983 Patton et al. ..... 166/267
4,560,003 * 12/1985 McMillen et al. ..... 166/305.1
4,811,791 * 3/1989 Harnoy et al. ..... 166/305.1
4,813,483 * 3/1989 Ziegler ..... 166/274
5,074,358 * 12/1991 Rendall et al. ..... 166/273
5,256,572 * 10/1993 Tang et al. ..... 426/179
5,314,017 * 5/1994 Schechter et al. ..... 166/252

* cited by examiner

*Primary Examiner*—William Neuder
*Assistant Examiner*—Jennifer R. Dougherty
(74) *Attorney, Agent, or Firm*—Gary P. Katz; Linda A. Kubena

(57) ABSTRACT

This invention provides a method for reducing the water saturation in the near-well region. Along with various well treatment possibilities, one application of this invention increases the injectivity rate of a substantially nonaqueous fluid into a subterranean formation. The preferred embodiment uses this invention to increase the injectivity of solvent gas into an oil-bearing formation for enhancing the amount and/or rate of oil recovery from the formation. The method includes injecting a second fluid into the near-well region of the injection well to displace at least a portion of the water from that region. Displacement of the water and subsequent displacement of the secondary fluid allow maximum injectivity for the primary solvent being injected for oil recovery.

29 Claims, 2 Drawing Sheets

METHOD TO REDUCE WATER SATURATION IN NEAR-WELL REGION

REFERENCE TO RELATED APPLICATIONS

This application claims the benefit of U.S. Provisional Application No. 60/106,863 filed Nov. 3, 1998.

FIELD OF THE INVENTION

This invention relates generally to the field of conditioning and treating the subterranean region near a wellbore, and more particularly to a method for reducing the water saturation in the near-well region of a subterranean formation. The inventive method may be used to facilitate various formation treatment procedures such as for increasing the injectivity rate of a substantially nonaqueous fluid into a subterranean formation.

BACKGROUND OF THE INVENTION

Water is naturally present in most subterranean formations of depositional origin including, without limitation, oil and gas reservoirs and coal deposits. In certain circumstances, it is desirable to displace water from a region near a wellbore in order to use treatment chemicals or procedures that may be adversely affected by excessive water, either through dilution or interference with the desired reaction. Examples of procedures that generally benefit from reduced water saturation in the near-well region include sand consolidation and polymer squeeze jobs, as well as other techniques that would benefit from greater contact with the reservoir matrix. In other circumstances, displacement of the water may itself be the desired treatment result. For gas injection used in tertiary recovery processes and other applications, educing the water saturation in the near-well region has a significant beneficial impact on gas injectivity. As used herein, the "near-well region" means that region in the vicinity of a wellbore the properties of which generally affect the flow of fluids into or out of the wellbore itself (as opposed to general reservoir flow patterns), usually, but not limited to, a radius of approximately two to as much as about fifty feet around the wellbore.

Although sand consolidation is no longer widely used, patents and publications from the 1970s suggest a variety of specific solvents to preflush the formation for water removal. Water interfered with successful sand consolidation more than oil, but oil removal was a secondary objective in many of the preflush proposals. The primary focus in selecting preflush solvents for sand consolidation work was on miscibility with both water and oil, with much of the selection process actually growing out of efforts to remove oil from the near-well region.

Several patented processes have also been presented for conditioning the near-well region for the purpose of acidizing the formation, with the focus in these patents being on oil removal to avoid the formation of emulsions during or after treatment. Few existing patents have addressed procedures focussed on the reduction of water saturation, especially as it relates to non-oil-bearing formations such as gas reservoirs or even aquifers. In itself, reduction of water saturation in the near-well region as a conditioning step before treatment will reduce dilution of treatment chemicals, allow better contact with the formation, and allow the use of treatments incompatible with water. In other cases, reduction of water saturation in the near-well region improves the relative permeability of the formation to oil, gas, or any other nonaqueous fluid. Changing relative permeabilities affects the potential recovery of oil or gas from a reservoir.

A significant amount of the crude oil contained in a subterranean formation is left in place after primary and secondary recovery processes. The crude oil left behind after secondary recovery processes can be as high as 20 to 50% of the original oil in place (OOIP). Water will also be present in the reservoir, as naturally occurring connate water, as a result of natural water drive, or as a result of injection for artificial water-flooding. Water as used herein will include any of the above, as well as fresh water, artificial brine, or any aqueous solution (e.g., solutions containing surfactants, polymers, acid, or any other additives) which might have been injected into the reservoir formation. Water saturation, $S_w$, is expressed as a percentage of the relevant reservoir pore volume, herein generally a percentage of the near-well pore volume.

Various tertiary recovery processes using solvents, chemicals, polymers, heat (including steam), or foams have been proposed or used to recover an additional percentage of the OOIP by improving the relative flow characteristics of the reservoir fluids and/or by sweeping reservoir fluids toward a production well. The economic and/or physical effectiveness of these processes often depends on maximizing contact with the remaining oil in the minimum possible time. Balancing maximum contact with minimum time makes the injectivity of the tertiary recovery materials into the reservoir a critical factor. Of course, the economics for any particular process are also dependent on the cost of the materials required. While solvents, chemicals, polymers, and surfactants, including those used to generate foams, vary in cost, the ready availability of carbon dioxide or natural gas often lead to lower cost per barrel of oil recovered than for other processes.

The objective of tertiary recovery processes is to reduce the residual oil saturation in the reservoir to its lowest possible value, thereby maximizing recovery of the OOIP. Residual oil saturation depends on the capillary number (defined more fully below), which in turn is dependent on fluid velocity, viscosity, and interfacial tension. As used herein, capillary number is an expression representing how readily a given fluid flows through the restricted pore spaces in the reservoir relative to the other fluids present. For example, miscible and near-miscible solvents blend with oil to reduce viscosity and eliminate (or significantly reduce) interfacial tension, thus maximizing the capillary number for the oil, which in turn leads to decreased residual oil saturation.

Solvent miscible flooding uses solvents that are either miscible with or near-miscible with the crude oil left behind by primary and secondary recovery processes. Some examples of solvents which could be used in miscible flooding include natural gas, methane, ethane, other natural gas components, condensate, alcohols, ketones, micellar solutions, carbon dioxide, nitrogen, flue gas and combinations of these. Generally, both economics and commercial availability make solvent gases more attractive than liquid solvents for use in miscible flooding. However, oil recovery from solvent gas processes is negatively impacted by the unfavorable mobility and density ratios between the oil and solvent gas, which lead to poor sweep efficiency. Specifically, an unfavorable mobility ratio between the gas and the oil allows solvent gas fingering or channeling resulting in low oil recoveries because not all of the residual oil is contacted by the solvent gas. Likewise, unfavorable density ratios can cause the solvent gas to migrate to the top of the reservoir bypassing much of the crude oil.

Often water injection is alternated with the solvent gas injection to mitigate the poor sweep performance of a solvent gas process. This process is called a Water-Alternating-Gas (WAG) process. A solvent process has better sweep when the water and solvent flow together in a commingled zone because water has a lower mobility ratio with respect to oil than the solvent gas does. The water tends to help sweep both the oil and the solvent gas through the reservoir. In a WAG process, the fraction of the reservoir swept by the solvent gas (the commingled zone) is proportional to the injection rate of the solvent gas. Therefore, increasing the injection rate can increase the sweep efficiency of a WAG process.

A more expensive alternative used to address the problems with sweep efficiency in WAG processes is to use a Surfactant-Alternating-Gas (SAG) process to generate foam in the reservoir. Foam in tertiary recovery projects reduces gas mobility in the reservoir, improving sweep efficiency more than water alone. Foam has the added advantage of preferentially reducing gas mobility in high permeability areas of the reservoir, further improving sweep efficiency in the lower permeability portions of the reservoir. In these situations, foam duration, or stability, is a desirable characteristic for sweep improvement. The disadvantage to using SAG is the added cost of the surfactant.

In addition to improving sweep efficiency in a WAG or SAG process, increasing the solvent injection rate accelerates the rate at which the oil is produced because the injected solvent more quickly enters the reservoir, contacts, and displaces the oil. Both increasing the oil recovery and accelerating the oil production are advantageous and will significantly improve the economic viability of a given recovery process.

Therefore, it is usually desirable to inject the gas (generally referred to herein as "primary solvent gas" to distinguish it from other fluids discussed) in a solvent gas process at the highest rate possible. The injection rate for the primary solvent gas, $Q_{psg}$, is determined by the following expression.

$$Q_{psg}=I_{psg}(P_{psg}-P_{res}) \quad (1)$$

In equation 1, $I_{psg}$ is the injectivity for the primary solvent gas, $P_{psg}$ is the injection pressure for the primary solvent gas, and $P_{res}$ is the reservoir pressure. Injection rates, Q, are expressed in units of volume per unit of time (e.g., standard cubic feet/day or barrels/day), P is expressed in units of pressure (e.g., psi), and I is expressed in the appropriate rate units over pressure (e.g. standard cubic feet/day/psi or barrels/day/psi). Therefore, a large injectivity, $I_{psg}$, indicates that a relatively high injection rate, $Q_{psg}$, can be sustained with a relatively low pressure difference between the pressure at which the primary solvent gas is injected, $P_{psg}$ and the reservoir pressure, $P_{res}$.

Although higher injection rates can be achieved by increasing the injection pressure, injection wells in most reservoirs are already operated near the maximum allowable well injection pressure. Increasing the injection pressure can lead to uncontrolled fracturing of the reservoir formation, which can cause a substantial reduction in oil recovery by causing diversion of the gas flow through the high permeability fracture or communication with other zones. Excessive pressure can also cause failure of the casing or other wellbore equipment. Therefore, there is a need for a method that can increase solvent injection rates without requiring an increase in injection pressure.

Currently the principal method of solvent-gas injection in a WAG process is to inject the solvent gas at a given wellhead pressure. This pressure is often determined by the limitations of the casing and other wellbore equipment, surface facilities, pipelines, and pumps. Injection pressure is also limited because it is generally not desirable for the pressure in the near-well region to be so high as to fracture the formation.

In a typical WAG process, water and solvent are injected in alternating cycles that last from about one week to many months. Within each cycle, solvent gas is injected to extract some portion of the oil from the rock and water is injected to displace the solvent gas and oil solution. Solvent injection volumes are generally expressed as a percentage of the reservoir pore volume. Typically, the volume of solvent injected into a given injection well during each cycle is about 1% to 5% of the pore volume targeted to be swept by injections into that well. In the near-well region, the oil saturation will generally be very low, often less than 15%, because large volumes of water at high flow rates have contacted the pore space. At the beginning of each solvent cycle, the water saturation in the near-well region may be as high as 65%–95% because water has just been injected. Therefore, the gas saturation may be as low as 5%–20% (with the remainder accounted for by any residual oil present), and the solvent gas mobility and corresponding injectivity are also low (explained more fully below). If, at the beginning of each solvent cycle, the water saturation were lower, both the solvent gas mobility and its injectivity would be greatly increased. With high water saturation, the gas is effectively blocked from flowing.

Currently one method used to increase solvent gas injectivity in a WAG process is to fracture the reservoir formation around the well. The fracture permits a solvent gas to be injected at a significantly higher rate because large flow paths are created that increase the injectivity when the fracture is formed. As noted above, however, the disadvantage of such a method is that fractures are difficult to control. An incorrectly placed fracture can cause the solvent gas to bypass much of the oil in place in the reservoir formation and decrease oil production. Therefore, fractures are usually avoided. In fact, much of the literature regarding solvent injection relates to methods of controlling mobility to limit the volume sweeping higher permeability portions of the reservoir. Uncontrolled fractures are an example of a very high permeability region that would take large volumes of solvent. Mobility control in higher permeability portions of the reservoir is one of the significant benefits of SAG and other foam flood processes.

A second method for increasing solvent gas injectivity is to inject acid into the reservoir formation around the near-well region. The acid will dissolve debris that can impede the flow of any injected gas. Once such debris is dissolved, the injectivity rate may be increased. While this method is useful, the extent to which acid can improve injectivity is generally limited to the extent that it removes debris from the wellbore area. Even with the removal of this debris, solvent injectivity may remain low because of the relative permeability effects discussed earlier. Acid injection also has the negative side effect of leaving the near-well region saturated with an aqueous liquid. Therefore, injecting acid to improve solvent injectivity has limited application.

A third method to increase solvent gas injectivity is to inject solvent for an extended period. As large volumes of unsaturated solvent contact the water over time, some vaporization occurs, effectively removing some of the water from the near-well region. This will increase the gas saturation and hence increase the gas injectivity (described below). Although injectivity improves over time, this process may take many months and significant volumes of solvent injection to remove sufficient water to achieve maximum gas injectivity. Thus, for much of the solvent injection cycle, solvent is being injected with a low injectivity. With the solvent injection cycle lengths in a typical WAG process, solvent gas injectivity can never reach its maximum value. A dramatic example of the change in solvent gas injectivity during the cycle is shown in FIG. 2, which depicts solvent injectivity 6 (solid line) and water injectivity 8 (dashed line) versus time over several cycles of a WAG flood. The solvent used in this example was carbon dioxide which is reported in barrels per day for comparison with reservoir pore volumes and water injection volumes. In FIG. 2, it can be seen that the solvent gas injection cycles are shorter than the time required for the gas injectivity 6 to stabilize at its maximum value. Since the desired water/solvent commingled zone will not form until water is injected, an extended solvent injection cycle would significantly delay formation of the commingled zone. This delay would reduce the sweep efficiency benefits of the WAG process.

A similar improvement in injectivity during the gas injection cycle was noted by W. R. Rossen, et al. in SAG modeling work (*Injectivity and Gravity Override in Surfactant-Alternating-Gas Foam Processes*, SPE 30753 presented at the SPE Annual Technical Conference, Dallas, October 1995), which indicated maximum injectivity after about 0.6 or more reservoir pore volumes of gas injection. Rossen, et al. theorized that over time, the injected solvent gas evaporated water from the foam lamellae in the near-well region causing the foam in that region to break down. With stable foams, there is still a significant period in which gas injectivity is less than optimal while the foam breaks down. Stable foams are generally desirable for the success of SAG processes.

Accordingly, there is a need for a method for reducing the water saturation in the near-well region to facilitate formation treatments such as sand consolidation and improvement of solvent injectivity to enhance the amount and/or rate of hydrocarbon recovery from a formation. The present invention provides an economical solution to this need.

SUMMARY OF THE INVENTION

This invention provides a method for reducing the water saturation in the near-well region by injecting a secondary fluid with a favorable capillary number into the near-well region to displace at least a portion of the water from that region. Along with various well treatment possibilities, one application of this invention increases the injectivity rate of a substantially nonaqueous fluid into a subterranean formation. A preferred embodiment of the invention uses this method to increase the infectivity of solvent gas into an oil-bearing formation for enhancing the amount and/or rate of oil recovery from the formation. In this embodiment, the method includes injecting a secondary fluid into the near-well region of the injection well to displace at least a portion of the water from that region. Displacement of the water and subsequent displacement of the secondary fluid allow maximum infectivity for the primary solvent being injected for oil recovery.

The secondary fluid may be the primary or a secondary solvent with the addition of a surfactant, a fluid with a high capillary number with respect to the water in the formation, or a foam comprising either the primary solvent or some secondary fluid with a surfactant. The secondary fluid should be selected to have a higher capillary number with respect to water than does the primary solvent alone.

BRIEF DESCRIPTION OF THE DRAWINGS

The present invention and its advantages will be better understood by referring to the following detailed description and the attached drawings in which.

DETAILED DESCRIPTION OF THE INVENTION

The present invention will be described in connection with its preferred embodiments. However, to the extent that the following description is specific to a particular embodiment or a particular use of the invention, this is intended to be illustrative only, and is not to be construed as limiting the scope of the invention. On the contrary, it is intended to cover all alternatives, modifications, and equivalents that are included within the spirit and scope of the invention, as defined by the appended claims.

The inventive method decreases the water saturation around the near-well region by forming a displacing phase in the region and using it to displace water and possibly other fluids from the region. The fluid used to form the displacing phase will generally be referred to herein as a "secondary fluid" to distinguish it from fluids already present in, previously injected into, or prospectively planned for injection into the reservoir. The displacing phase is formed primarily from a secondary fluid, which is injected in the formation at the near-well region, but there may also be other components injected with the secondary fluid. Some examples of components that may be injected with a secondary fluid include foaming agents, nonaqueous surfactant solutions, or aqueous surfactant solutions, hereafter referred to collectively as "surfactants."

Figure 3:
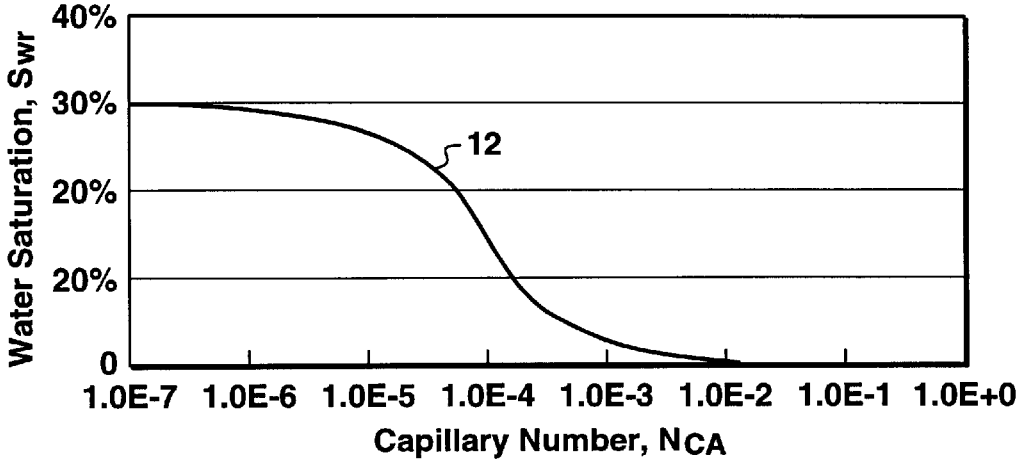
FIG. 3 is an illustration of the expected general correlation between capillary number, $N_{CA}$, and the resulting residual water saturation, $S_{wr}$, expressed as a percentage of reservoir pore volume.

The displacing phase will decrease the water saturation because it has a high capillary number with respect to water. Although the capillary number concept has been applied extensively to applications involving determination or reduction of residual oil, the petroleum industry does not appear to have applied the concept to reduction of residual water saturations. FIG. 3 illustrates the general relationship between capillary number and residual water saturation 12, showing the benefit of increasing the capillary number, especially above about $1\times10^{-5}$ in this example. The capillary number between the water and displacing phase controls residual water saturation, where capillary number is defined as follows:

$$N_{CA}=(V_{DP}\times\mu_{DP})/(IFT_{DP.H2O}) \quad (2)$$

where $V_{DP}$ is the interstitial velocity of the displacing phase, $\mu_{DP}$ is the viscosity of the displacing phase, and $IFT_{DP.H2O}$ is the interfacial tension between the displacing phase and water. Consequently, the $N_{CA}$ of the displacing phase can be increased by increasing $V_{DP}$, increasing $\mu_{DP}$, and/or decreasing $IFT_{DP.H2O}$ around the near-well region. It is possible to increase the capillary number by increasing the flow rate of the displacing phase. Indeed, within the first few feet around the well, the flow rate of an injected fluid may be high enough to displace water even without unusually high viscosity or unusually low interfacial tension. However, to displace water beyond about one to two feet, the flow rate would have to be higher than is practically achievable. The inventive method, however, maximizes $N_{CA}$ primarily by increasing $\mu_{DP}$ and/or decreasing $IFT_{DP.H2O}$ around the near-well region.

Those skilled in the art will recognize that the capillary number curve for a given application will be dependent on the reservoir properties and that some experimentation may be required to determine the capillary number above which benefits will be achieved in a given situation. Such experimentation would only be necessary if one wished to operate in the lower ranges of the capillary number curve. The spirit of this invention is not based on operating at a particular numerical value on the capillary number curve, but rather on the general relationship that increasing the capillary number will tend to reduce the residual water saturation.

As discussed above, the inventive method requires a secondary fluid for forming a displacing phase in the near-well region (in injection applications the primary solvent can be the secondary fluid). One characteristic of the secondary fluid is its ability to form a displacing phase with a relatively high capillary number with water, preferably above about $1\times10^{-5}$, more preferably above about $1\times10^{-4}$, and even more preferably above about $1\times10^{-3}$, in the example shown in FIG. 3. This results in a water saturation, $S_{w2}$, that is less than the initial water saturation, $S_{w1}$. Once the water saturation is reduced, there will be a corresponding increase in permeability to non-aqueous fluids, which permits treatment chemicals to obtain a greater mobility than they would have had in the same rock with the water saturation at $S_{w1}$. Mobility of the treatment chemicals is a significant benefit, but in some cases, the greater benefit may be reduction of physical or chemical interference by water in the treatment process.

Reducing physical interference by water would be of benefit in various sand consolidation or polymer squeeze treatments, in which the treatment effectiveness is maximized when contact with the reservoir matrix is improved. Use of the various embodiments described below for reducing water saturation would also improve the effectiveness of or make possible treatment with chemicals that have some incompatibility with water, whether the result is an emulsion or simply dilution of the desired treatment concentration.

In a preferred embodiment, the inventive method decreases water saturation in the near-well region below that normally achievable during a solvent cycle of a WAG process, and thereby increases the primary solvent gas injectivity. The primary solvent gas, as used herein, means the solvent gas used for extracting oil from reservoir rock. Although the preferred embodiment described is in reference to crude oil, oil should be understood to include any liquid hydrocarbon present in an underground formation whether or not naturally occurring in that location and specifically including condensate, tar, any coal or gas liquefaction products, and any hydrocarbon products which may have been stored underground. Preferably, a primary solvent gas should be economical and readily available commercially. A secondary fluid, as used herein, means the fluid used for forming a displacing phase in the near-well region for displacing water from the near-well region at the start of the primary solvent gas cycle. However, as discussed more fully below, in certain applications a secondary fluid may be the same as the primary solvent gas when additives are used to change the fluid properties to increase the capillary number.

Specifically, the inventive method increases the injectivity of a primary solvent, $I_{psg}$ by increasing its mobility in the near-well region. In a given reservoir situation, the injectivity of a solvent, $I_{psg}$. is proportional to the relative mobility, $M_{psg}$, of that solvent. The relative mobility of the primary solvent, $M_{psg}$, is defined in equation 3 below:

$$M_{psg}=k_{psg}/\mu_{psg} \tag{3}$$

where $k_{psg}$ is the relative permeability of the primary solvent and $\mu_{psg}$ is the viscosity of the primary solvent. Therefore, $M_{psg}$ can be increased by increasing $k_{psg}$ and/or decreasing $\mu_{psg}$.

Figure 1:
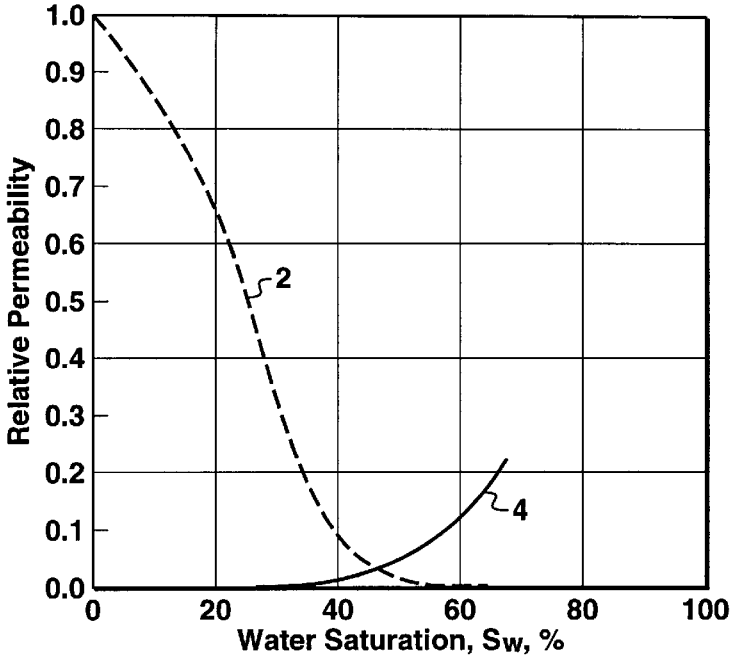
FIG. 1 is a plot of the general relationship between water saturation, $S_w$, and the relative permeabilities to solvent, $k_{psg}$, and water, $k_{rw}$, respectively.
Figure 2:
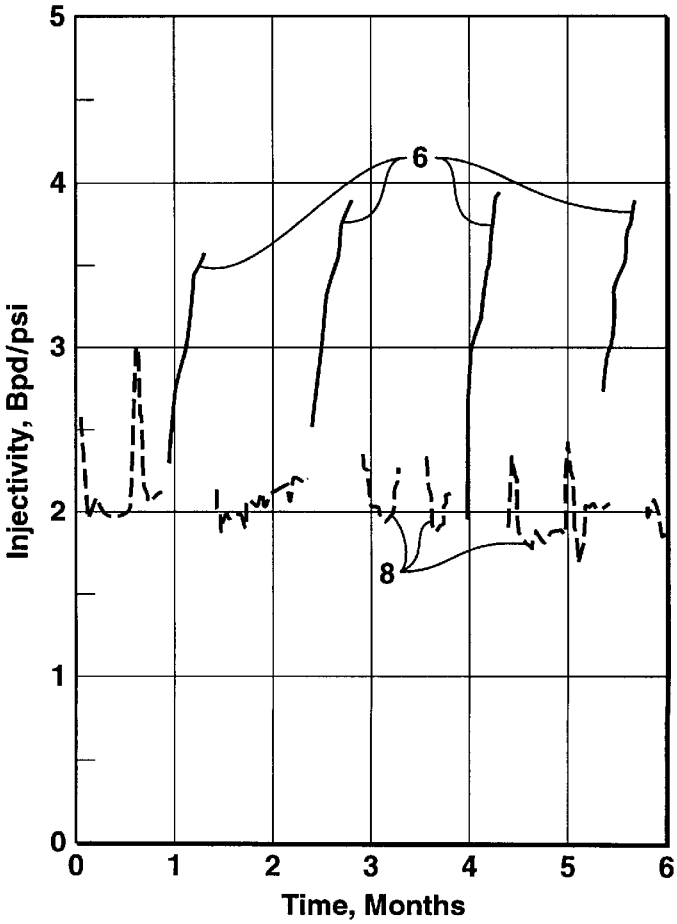
FIG. 2 is a plot of daily solvent and water injectivities observed over a six-month period for one well in a WAG project, illustrating the potential for improvement in gas injectivity as water saturation in the near-well region is reduced.

Displacing water from the near-well region, which decreases the water saturation, $S_w$, can increase the $k_{psg}$. In FIG. 1, dashed line 2 represents the general relationship between water saturation and solvent relative permeability. FIG. 1 shows that a small change in water saturation can change the solvent relative permeability significantly. Referring to FIG. 1, for example, a $S_w$ of 35% yields a $k_{psg}$ of about 0.15, while a $S_w$ of 30% yields a $k_{psg}$ of about 0.35. This figure is included for illustrative purposes only and is not intended to define or limit any particular embodiment of this invention. In FIG. 1, solid line 4 illustrates the general relationship for relative permeability to water.

During usual WAG processes, the water saturation, $S_{w1}$ around the injection well during solvent gas injection is typically in the range of about 15% to about 50%, starting as high as about 65% to about 95%. Employing the inventive method, however, water saturation can be lowered by increasing the $N_{CA}$ between the water and the primary solvent gas or displacing fluid. This lower water saturation, $S_{w2}$, 12 would preferably fall in a range of about 0% to about 15%, as can be seen in FIG. 3, but any reduction will result in improved primary solvent injectivity. FIG. 3 shows the residual water saturation, $S_w$, generally achievable with a given capillary number, which would correspond to the potential $S_{w2}$ at those conditions. Referring back to FIG. 1, we can see how such a reduction in $S_w$ can increase the relative permeability for the primary solvent gas, $k_{spg}$, by as much as about one order of magnitude.

The inventive method, therefore, improves solvent gas injectivity into an injection well by increasing the mobility of the solvent gas in the near-well region. Reducing the water saturation around the near-well region from $S_{w1}$, to $S_{w2}$ increases the mobility of the solvent gas. The water saturation is lowered by increasing the capillary number of the displacing phase with respect to water relative to the capillary number of the primary solvent with respect to water.

As discussed above, the inventive method requires a secondary fluid for forming a displacing phase in the near-well region. In injectivity applications, one characteristic of the secondary fluid is its ability to form a displacing phase with a relatively high capillary number with water compared with the capillary number for the primary solvent gas and water. Consequently, the displacing phase has a capillary number, $N_{CA2}$, that is greater than the capillary number for the primary solvent gas, $N_{CA1}$. This results in a water saturation, $S_{w2}$, that is less than initial water saturation, $S_{w1}$ and less than the water saturation achievable through primary solvent injection. Most secondary fluids have the additional benefit of greater sweep efficiency than the primary solvent gas alone, improving not only the water saturation of the portion of the formation contacted, but also increasing the volumetric percentage of the formation contacted. The primary solvent gas then can be injected into the formation to displace at least a portion of secondary fluid. Once the water saturation is reduced, there will be a corresponding increase in $k_{psg}$, which permits the primary solvent gas to obtain a greater mobility than it would have had in the same rock with the water saturation at $S_{w1}$. As discussed above, such an increase in the mobility will lead to an increase in the injectivity for the primary solvent gas.

A first embodiment of the inventive method involves using foams to reduce water saturation in the near-well region, thereby improving gas injectivity. Under this embodiment, a foam operates as the displacing phase. A foam is a fluid dispersion comprising a large volume of solvent gas in a relatively small volume of liquid. The foam is formed by injecting a foaming agent or surfactant solution either before or simultaneously with the secondary solvent gas. Foam flow is described in terms of effective viscosity, which means that although the components of the foam individually have low viscosities, because of the lamellar structure of the foam it behaves as though it has a much higher viscosity. References to viscosity herein will be understood to include effective viscosity. Because the effective viscosity of the foam is higher than the viscosity of the primary solvent gas, and the interfacial tension between the foam and the water is generally either lower than for the primary solvent gas or about the same, the capillary number with the foam, $N_{CA2}$, is higher than $N_{CA1}$. This results in a water saturation, $S_{w2}$, that is lower than $S_{w1}$.

Figure 4:
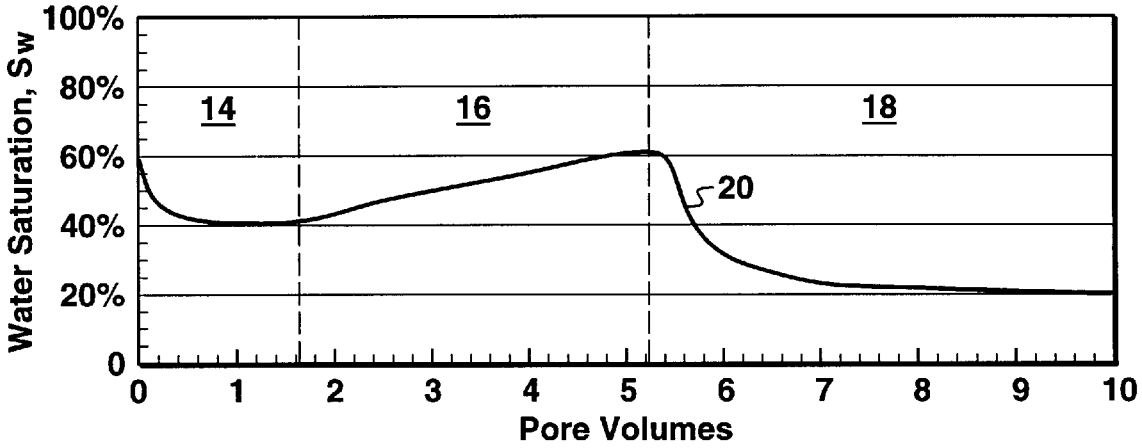
FIG. 4 is a plot of water saturation, $S_w$, measured during a laboratory coreflood experiment as a function of the pore volumes of fluid injected, showing the greater reduction in water saturation possible with surfactant present.

FIG. 4 shows that the foam forming surfactant solution facilitates reducing the water saturation, $S_w$. Referring to FIG. 4, water saturation 20 is shown as a function of pore volumes of fluids injected. When $CO_2$ was injected without the surfactant solution (shown at reference numeral 14), the water saturation at the beginning of the cycle was 60% and only decreased to about 40% with about 1.6 pore volumes of $CO_2$ injection. However, after surfactant solution was injected (shown at reference numeral 16) and $CO_2$ was again injected (reference numeral 18), the measured viscosity of the $CO_2$ as part of the foam was significantly higher than before surfactant solution injection. This higher effective viscosity foam displaced water and the water saturation decreased from about 60% to about 25% after injection of the same volume of $CO_2$ as in the original case. The higher viscosity of the foam and the reduced interfacial tension between the foam and the water allowed the foam to displace significantly more water than the $CO_2$ alone.

Once $S_{w2}$ is less than $S_{w1}$, the relative permeability for the primary solvent gas will increase. After the foam dissipates and the effective viscosity of the displacing phase decreases, the gas mobility of the primary solvent gas is increased to a value $M_2$ which is greater than the mobility, $M_1$, the primary solvent gas would have had in the reservoir with initial water saturation, $S_{w1}$, Consequently, the injectivity for the primary solvent gas will increase in proportion with this increase in mobility.

After the foam has formed and displaced water to reduce the water saturation, $S_w$, in the near-well region, a reduction in the effective viscosity of the foam is required to permit an increase in mobility for the primary solvent gas. Such a reduction can be accomplished by allowing or causing the foam to break down. The time required for such dissipation and the method by which the foam is dissipated can vary depending upon the application. Preferably, the foam will dissipate in the range of 1 to 48 hours for most applications. The amount of foam dissipation required is determined by the increase in the primary solvent gas mobility desired. However, in most applications of the inventive method using a foam displacing phase, the foam will need to dissipate to a point which will produce a mobility value for the primary solvent gas which is greater than it would have had without using a displacing phase foam to lower the water saturation.

As mentioned above, a variety of foam dissipation methods may be employed. One foam dissipation method is to allow the foam to dissipate naturally. Natural foam dissipation means that thin-film lamellae of the foam break causing the effective viscosity of the foam to decrease. D'Souza observed this effect in U.S. Pat. No. 5,193,617 and disclosed a method for overcoming the effects of natural foam dissipation. To reduce the natural foam dissipation effect, D'Souza recommended injecting microslugs of a surfactant solution to maintain the lower injectivity observed when foam is formed in the reservoir. The foam's effective life in the reservoir is thereby extended. The inventive method disclosed herein, however, requires at least partial dissipation of the foam to improve any subsequent solvent gas injectivity.

A similar effect has been observed by W. R. Rossen, et. al. (cited above) in SAG processes. They observed the beneficial impact of foam breaking down in the near-well area during a foam flood project. The beneficial impact observed was after injection of 0.6 or more pore volumes of solvent gas, which is consistent with the injectivity benefit of long term solvent injection in WAG processes and indicates that much greater benefit is available by applying the inventive process.

There are two sequences in which the foam may naturally dissipate under the inventive method. One sequence is for the foam to dissipate before the primary solvent gas is injected. With this method, the foam will dissipate in the presence of the secondary fluid. A second sequence is for the foam to dissipate after the primary solvent gas injection has resumed. Also, recall from previous discussion that in certain applications, the primary and the secondary solvent may be the same, but nonetheless, either of these sequences can be applied.

A second foam dissipation method involves inducing or accelerating foam dissipation. Preferably, foam dissipation is accelerated by using an unstable foam. An unstable foam is foam which has a short lifetime, as in the situation where the surfactant was selected based on rapid degradation at reservoir conditions. Because the surfactant acts as a foaming agent, the foam will naturally break down as the surfactant degrades. For example, such a foam would have a lifetime of about one to as much as about forty-eight hours, while a naturally stable foam typically has a lifetime exceeding forty-eight hours. However, injecting a foam-breaking agent into the primary or secondary solvent may accelerate dissipation of either naturally stable or unstable foams. In certain applications, it may be preferable to induce foam dissipation by injecting either a primary or secondary solvent with or without a foam-breaking agent such as an alcohol (e.g., methanol) or an acid (e.g., hydrochloric acid). Other foam-breaking agents are known in the art. Alternatively, the foam-breaking agent could be injected into the formation separately.

The inventive method using foam relies on the foam's ability to efficiently displace water because of the foam's higher viscosity and lower interfacial tension. FIG. 4 shows laboratory coreflood data demonstrating that final water saturations using foam injection 18 are lower than after gas injection without surfactant present 14. The water is more efficiently displaced because the surfactant interacts with the solvent gas in the foam to form thin-films that retard the solvent flow. The resulting higher effective viscosity leads to a more favorable displacement of the water from the region the surfactant contacted. Once the water saturation is reduced around the well, the foam will dissipate, if properly designed, leaving higher gas saturation in the reservoir than was present before applying the inventive method. The decrease in water saturation around the injection well leads to higher gas relative permeabilities, as seen in FIG. 1, leading to improved solvent gas injectivities.

Although the foam will have a negative effect on injectivity of the primary solvent gas for a brief time, this effect will be negligible if the primary solvent gas injection period is of sufficient duration and the foam dissipates in a sufficiently short time. Once the foam substantially dissipates, the relative permeability of the primary solvent will have increased and an enhanced primary solvent gas injectivity can be realized. As discussed above, such foam dissipation can be accelerated using a surfactant, which breaks down at conditions in the near-well region, so the foam dissipates as the surfactant degrades. Alternatively, a more stable surfactant structure yielding an unstable foam at moderate water saturations may be used. A third alternative is to use an additive that destroys either the surfactant or the foam structure.

Another embodiment of the inventive method involves injecting a secondary fluid without a surfactant solution to form a displacing phase. The secondary fluid would have a lower interfacial tension with the water around the wellbore than the primary solvent gas and/or have a higher viscosity than the primary solvent gas. A change in capillary number by a multiple of about five or ten could have a significant impact on residual saturations 12 (FIG. 3) depending on where on the curve the first and second capillary numbers fell. For example, such a secondary fluid could be a polar hydrocarbon such as an alcohol or ketone that can displace water and then itself be displaced by the primary solvent gas.

A fluid with a viscosity that is significantly higher than and preferably at least twice the viscosity of the water in the near-well region would also have a beneficial impact on the capillary number relationship. This fluid could be a non-aqueous fluid with an additive that increases the viscosity of the displacing phase. Using concepts similar to those currently used in fracturing technology, the viscosity could be reduced after displacement of the water, either through breakdown at reservoir conditions or through the injection of another compound into the near-well region to facilitate the viscosity reduction. Reducing the viscosity of the displacing phase following the displacement of water may be necessary for the success of subsequent operations such as gas injection.

A decrease in water saturation to $S_{w2}$ and corresponding increase in mobility to $M_2$ for the primary solvent gas will be affected through a higher capillary number, $N_{CA2}$. Consequently, an increase in the injectivity for the primary solvent gas is obtained. If the primary solvent gas is miscible with the secondary fluid, a favorable capillary number then provides for effective displacement of the secondary fluid by the primary solvent gas in gas injection operations.

A third embodiment of the inventive method is to inject an aqueous or nonaqueous surfactant solution with the secondary fluid. The surfactant solution can be injected prior to the injection of the secondary fluid or simultaneously with the secondary fluid. The combination of the secondary fluid and surfactant solution will form the displacing phase. The surfactant solution will lower the interfacial tension between the displacing phase and the water, $IFT_{DP.H2O}$, around the near-well region. As a result of the reduced interfacial tension, the surfactant solution/secondary fluid phase will have capillary number, $N_{CA2}$, that is higher than the capillary number for the primary solvent gas, $N_{CA1}$. The secondary fluid is then able to more effectively displace the water (which may now also contain part of the surfactant solution if an aqueous surfactant is used). This results in a water saturation, $S_{w2}$, that is lower than $S_{w1}$. The secondary fluid is then at least partially displaced from the near-well region. Because the new water saturation, $S_{w2}$, is lower than the initial water saturation, $S_{w1}$, the relative permeability for the primary solvent gas, $k_{spg}$, will increase. Therefore, the primary solvent gas mobility will increase to a mobility, $M_2$, that is greater than the mobility it would have had in the same formation with the water saturation at $S_{w1}$. Consequently, an increase in the infectivity for the primary solvent gas is obtained.

In addition, the above embodiments of the inventive method can be implemented using the same solvent gas as both the primary and secondary solvent gas. In such a case, the displacing phase would be comprised of the solvent gas and a surfactant which will have a capillary number that is higher than the capillary number of the solvent gas without the surfactant solution.

The second and third embodiments discussed above can also be used by displacing the secondary fluid with the primary solvent gas, whether the secondary fluid is substantially miscible with the primary solvent gas or not. Preferably, substantially all of the secondary fluid is displaced from the near-well region. However, an increase in mobility of the primary solvent gas will be obtained provided there is some decrease in the water saturation and at least a portion of the secondary fluid is displaced.

Although the embodiments discussed above are primarily related to the beneficial effects of the inventive process when applied to WAG tertiary recovery processes, this should not be interpreted to limit the claimed invention which is applicable to any situation in which reduction of the water saturation in the near-well region is beneficial. Criteria for selection of the secondary fluid have been provided and those skilled in the art will recognize that many fluids not specifically mentioned in the examples will be equivalent in function for the purposes of this invention.

What we claim is:

1. A method for reducing the water saturation in the near-well region of a subterranean formation having a well, said near-well region containing at least some water and having a corresponding first water saturation, $S_{w1}$, said method comprising:

a) selecting a displacing phase, wherein said displacing phase is selected to have a capillary number, $N_{CA}$, with respect to the water sufficient to cause a reduction in residual water saturation in the portion of the subterranean formation contained in the near-well region;

b) introducing said displacing phase into said near-well region;

c) displacing at least a portion of the water from said near-well region; and d) thereby producing a second water saturation, $S_{w2}$, corresponding to $N_{CA}$, which is less than $S_{w1}$ wherein said capillary number for a given displacing phase, $N_{CA}$, is determined by the following equation:

$$N_{CA}=(V_{DP}\times\mu_{DP})/(IFT_{DP.H2O})$$

where $V_{DP}$ is the interstitial velocity of said displacing phase, $\mu_{DP}$ is the viscosity of said displacing phase, and $IFT_{DP.H2O}$ is the interfacial tension between said displacing phase and water.

2. The method of claim 1 wherein said displacing phase includes a fluid selected from the group consisting of natural gas, any individual component of natural gas, condensate, carbon dioxide, nitrogen, flue gas, aromatics, alcohols, ketones, amphipathic solvents, polar hydrocarbons, micellar solutions, aqueous or nonaqueous surfactant solutions, and any combination thereof.

3. The method of claim 1 wherein said displacing phase is a foam comprising a fluid and a surfactant solution.

4. The method of claim 3 wherein said surfactant solution is injected into said near-well region before said fluid.

5. The method of claim 3 wherein said foam substantially dissipates within about 48 hours.

6. The method of claim 3 wherein said foam is substantially dissipated by injection of a substance into said near-well region to facilitate dissipation.

7. The method of claim 1 wherein said displacing phase is formed by injecting a fluid into said near-well region and forming said displacing phase in said near well region.

8. The method of claim 1 wherein said displacing phase is formed at the surface of the earth and then injected in said near-well region.

9. The method of claim 1 further comprising selecting said displacing phase such that said capillary number is greater than about $1\times10^{-5}$.

10. A method for improving the injectivity of a primary solvent in the near-well region of a subterranean formation having a well, said near-well region containing at least some water and having a corresponding first water saturation, $S_{w1}$, with respect to said water and said primarv solvent having a first relative mobility, $M_1$, with respect to said water, said method comprising:

a) selecting a substantially nonaqueous primary solvent from the group consisting of natural gas, any individual component of natural gas, condensate, carbon dioxide, nitrogen, flue gas, aromatics, alcohols, ketones, amphipathic solvents, polar hydrocarbons, micellar solutions, nonaqueous surfactant solutions, and any combination thereof;

b) determining a first capillary number, $N_{CA1}$, of said primary solvent with respect to the water, where the capillary number for a given displacing phase (here the primary solvent), $N_{CA}$, is determined using the following equation:

$$N_{CA}=(V_{DP}\times\mu DP)/(IFT_{DP.H2O})$$

where $V_{DP}$ is the interstitial velocity of the displacing phase, $\mu_{DP}$ is the viscosity of the displacing phase, and $IFT_{DP.H2O}$ is the interfacial tension between the displacing phase and water;

c) selecting a secondary fluid from the group consisting of natural gas, any individual component of natural gas, condensate, carbon dioxide, nitrogen, flue gas, aromatics, alcohols, ketones, amphipathic solvents, polar hydrocarbons, micellar solutions, aqueous or nonaqueous surfactant solutions, and any combination thereof;

d) injecting the selected secondary fluid into the near-well region;

e) forming a displacing phase, said displacing phase comprising said secondary fluid, and said displacing phase having a capillary number, $N_{CA2}$, with respect to the water such that $N_{CA2}$ for said displacing phase is greater than $N_{CA1}$ for the primary solvent;

f) displacing at least a portion of the water from the near-well region; and g) thereby producing a second water saturation, $S_{w2}$, corresponding to $N_{CA2}$, which is less than $S_{w1}$ h) removing at least a portion of the displacing phase from the near-well region now having $S_{w2}$; and i) injecting the primary solvent in the near-well region now having $S_{w2}$, said primary solvent now having a second relative mobility, $M_2$, with respect to the water, with $M_2$ being greater than $M_1$.

11. The method of claim 10 further comprising selecting the secondary fluid such that said capillary number is greater than about $1\times10^{-5}$.

12. The method of claim 10 further comprising selecting the secondary fluid such that said capillary number is greater than about $1\times10^{-4}$.

13. The method of claim 10 further comprising selecting the secondary fluid such that said capillary number is greater than about $1\times10^{-3}$.

14. The method of claim 10 wherein the secondary fluid is a substantially nonaqueous fluid having a viscosity which is greater than about double the viscosity of the water.

15. The method of claim 10 wherein the secondary fluid includes a surfactant solution and the displacing phase is a foam comprising said surfactant solution.

16. The method of claim 15 wherein the foam substantially dissipates before injecting the primary solvent.

17. The method of claim 15 wherein the foam is substantially dissipated by the primary solvent.

18. The method of claim 15 wherein at least one additive to facilitate the dissipation of the foam is injected with the primary solvent.

19. The method of claim 10 wherein the secondary fluid is substantially miscible with the primary solvent.

20. The method of claim 10 wherein the secondary fluid is substantially displaced by the primary solvent in the near-well region.

21. The method of claim 10 wherein a surfactant solution is injected before the secondary fluid.

22. A method for improving the injectivity of a primary solvent in the near-well region of a subterranean formation having a well, said near-well region containing at least some water and having a corresponding first water saturation, $S_{w1}$, with respect to said water and said primary solvent having a first relative mobility, $M_1$ with respect to said water, said method comprising:

a) selecting a substantially nonaqueous primary solvent from the group consisting of natural gas, any individual component of natural gas, condensate, carbon dioxide, nitrogen, flue gas, aromatics, alcohols, ketones, amphipathic solvents, polar hydrocarbons, micellar solutions, nonaqueous surfactant solutions, and any combination thereof;

b) determining a first capillary number, $N_{CA1}$, of said primary solvent with respect to the water, where the capillary number for a given displacing phase (here the primary solvent), $N_{CA}$, is determined using the following equation:

$$N_{CA}=(V_{DP}\times\mu DP)/(IFT_{DP.H2O})$$

where $V_{DP}$ is the interstitial velocity of the displacing phase, $\mu_{DP}$ is the viscosity of the displacing phase, and $IFT_{DP.H2O}$ is the interfacial tension between the displacing phase and water;

c) selecting a secondary fluid from the group consisting of natural gas, any individual component of natural gas, condensate, carbon dioxide, nitrogen, flue gas, aromatics, alcohols, ketones, amphipathic solvents, polar hydrocarbons, micellar solutions, aqueous or nonaqueous surfactant solutions, and any combination thereof;

d) injecting a surfactant solution and the secondary fluid into the near-well region;

e) forming a displacing phase, said displacing phase comprising said surfactant solution and said secondary fluid, and said displacing phase having a capillary number, $N_{CA2}$, with respect to the water such that $N_{CA2}$ for said displacing phase is greater than $N_{CA1}$ for the primary solvent;

f) displacing at least a portion of the water from the near-well region; and g) thereby producing a second water saturation, $S_{w2}$, corresponding to $N_{CA2}$, which is less than $S_{w1}$ h) removing at least a portion of the displacing phase from the near-well region now having $S_{w2}$; and i) injecting the primary solvent in the near-well region now having $S_{w2}$, said primary solvent now having a second relative mobility, $M_2$, with respect to the water, with $M_2$ being greater than $M_1$.

23. The method of claim 22 wherein the surfactant solution is injected before injecting the secondary fluid.

24. The method of claim 22 wherein the displacing phase is a foam comprising the surfactant solution and the secondary fluid.

25. The method of claim 24 wherein the foam substantially dissipates before injecting the primary solvent.

26. The method of claim 24 wherein the foam is substantially dissipated by the primary solvent.

27. The method of claim 24 wherein at least one additive to facilitate the dissipation of the foam is injected with the primary solvent.

28. The method of claim 22 wherein the secondary fluid is substantially miscible with the primary solvent.

29. The method of claim 22 wherein the secondary fluid is substantially displaced by the primary solvent in the near-well region.

* * * * *